US008071014B2

(12) United States Patent
Irnich

(10) Patent No.: US 8,071,014 B2
(45) Date of Patent: Dec. 6, 2011

(54) APPARATUS AND METHOD FOR CLOSING OR OPENING AN OPENING, ESPECIALLY A BOTTOM OPENING OF A MATERIAL HOPPER FOR A BLAST FURNACE, AND BLAST FURNACE HAVING SUCH AN APPARATUS

(75) Inventor: Franz-Josef Irnich, Hürthgenwald (DE)

(73) Assignee: Z & J Technologies GmbH, Duren (DE)

( * ) Notice: Subject to any disclaimer, the term of this patent is extended or adjusted under 35 U.S.C. 154(b) by 486 days.

(21) Appl. No.: 12/134,623

(22) Filed: Jun. 6, 2008

(65) Prior Publication Data

US 2008/0302796 A1 Dec. 11, 2008

(30) Foreign Application Priority Data

Jun. 8, 2007 (DE) ..... 10 2007 026 509

(51) Int. Cl.
*B65D 43/26* (2006.01)

(52) U.S. Cl. ..... 266/199; 222/185.1; 220/263

(58) Field of Classification Search ..... 266/199; 220/817, 263; 251/229; 222/185.1
See application file for complete search history.

(56) References Cited

U.S. PATENT DOCUMENTS

| | | | | |
|---|---|---|---|---|
| 3,704,992 | A * | 12/1972 | Nieboer | 414/201 |
| 4,844,292 | A * | 7/1989 | Lonardi et al. | 222/503 |
| 5,285,811 | A * | 2/1994 | DiLuigi et al. | 137/347 |
| 6,543,747 | B2 * | 4/2003 | Buchwald et al. | 251/279 |
| 6,792,973 | B2 * | 9/2004 | Lonardi et al. | 137/527.6 |
| 6,897,412 | B1 * | 5/2005 | Miller et al. | 219/400 |
| 7,156,371 | B2 | 1/2007 | Engl et al. | |

FOREIGN PATENT DOCUMENTS

| | | | |
|---|---|---|---|
| BE | 849156 | A | 4/1977 |
| DE | 613328 | A | 5/1935 |
| DE | 103 27 276 | A1 | 1/2005 |
| EP | 0 997 698 | A1 | 5/2000 |

* cited by examiner

*Primary Examiner* — Scott Kastler
*Assistant Examiner* — Michael Aboagye
(74) *Attorney, Agent, or Firm* — Alston and Bird LLP

(57) ABSTRACT

An apparatus is provided for closing or opening an opening, especially a bottom opening of a material hopper arranged above the mouth of a blast furnace having a drivable flap plate, which is movable into an open position leaving the opening clear and into a closed position blocking off the opening and vice-versa. The flap plate carries out, in the region of the opening, a linear movement substantially perpendicular to the plane of the opening and, distal to the opening, a pivoting movement.

13 Claims, 4 Drawing Sheets

APPARATUS AND METHOD FOR CLOSING OR OPENING AN OPENING, ESPECIALLY A BOTTOM OPENING OF A MATERIAL HOPPER FOR A BLAST FURNACE, AND BLAST FURNACE HAVING SUCH AN APPARATUS

BACKGROUND OF THE INVENTION

1. Field of the Invention

Embodiments of the present invention relate to an apparatus and method for closing or opening an opening, especially a bottom opening of a material hopper for a blast furnace, and a blast furnace having such an apparatus.

2. Description of Related Art

DE 103 27 276 A1, for example, discloses an apparatus including a shut-off flap valve or furnace mouth flap valve, which is used to control the charging of a blast furnace with coke and burden material. For the purpose, the apparatus includes a flap plate which, for the purpose of closing or opening the bottom opening of a material hopper arranged above the mouth of a blast furnace, is movable into an open position and into a closed position. In order to move the flap plate into the desired position, a drive mechanism is usually in articulated connection at the flap rim, by which it is ensured that, in the open position, the flap plate leaves the flow opening substantially completely clear. In the process, however, the flap plate is pivoted out relatively far away from the opening, so that the mouth of the blast furnace has to be correspondingly dimensioned in order to avoid a collision of the flap plate with loose material.

In the case of the furnace mouth flap valve according to DE 103 27 276 A1, this disadvantage is avoided by the fact that the flap plate is in articulated connection with two pivot arms which are mounted so that they can pivot about pivot axes that extend parallel to one another. It is ensured therein that, when the flap plate moves from the closed position into the open position and vice-versa, the rim regions of the flap plate move along oppositely directed arcuate paths. The multiply superimposed tilting/translational movement of the flap plate obtained in that manner brings about a movement of the flap plate on a trajectory close to the bottom opening, as a result of which the mouth of the blast furnace can be of more compact construction overall.

Guiding the flap plate along the arcuate paths brings about, in the region of the opening, a relative movement between the rim region of the flap plate and the sealing seat provided for the flap plate at the bottom opening. Especially when the sealing region of the flap plate is in contact with the sealing seat of the bottom opening, a relative movement parallel to the plane of the opening is damaging and can result in premature wear of the sealing provisions.

BRIEF SUMMARY OF THE INVENTION

One goal of the embodiments of the invention is to improve a closure apparatus so that low-maintenance operation is made possible in a simple manner, and to avoid premature wear on the sealing system. Another goal is furthermore to provide a blast furnace having such an apparatus and a method of closing or opening an opening, especially a bottom opening of a material hopper arranged above the mouth of a blast furnace.

An apparatus is provided for closing or opening an opening, especially a bottom opening of a material hopper arranged above the mouth of a blast furnace having a drivable flap plate, which is movable into an open position leaving the opening clear and into a closed position blocking off the opening and vice-versa. The flap plate is connected to a linkage arrangement in such away that the flap plate carries out, in the region of the opening, a linear movement substantially perpendicular to the plane of the opening and, distal to the opening, a pivoting movement.

In this manner, a relative movement across the flow direction, or in the plane of the opening, is practically and advantageously avoided as a result of the linear movement of the flap plate. The resultant reduced friction on setting down and lifting off the flap plate reduces the wear on the sealing provisions, so that there is a lower maintenance requirement. At the same time, the compact mode of construction of the furnace mouth can be retained because the flap plate carries out, distal to the opening, a pivoting movement and accordingly is guided close to the opening or corresponding housing.

Preferably, the pivoting movement of the flap plate includes, at least in the region of overlap of the flap plate with the opening, a translational movement parallel to the plane of the opening, on which there is superimposed a rotational movement. As a result it is ensured that the flap plate is moved out from the region of the opening without taking it too far away from the opening in the flow direction, in order to avoid a collision with loose material.

Preferably, the linkage arrangement includes a four-bar linkage, which couples the flap plate to a drive. A linkage arrangement of such a kind makes possible, in constructionally simple and robust manner, the linear movement of the flap plate in the region of the opening and also the pivoting movement distal to the opening.

The linkage arrangement can include an actuation lever and a plate lever, which have axes of rotation arranged in a fixed position and spaced apart from one another. In this case, the actuation lever and the plate lever can be coupled together by a first rotation joint. The plate lever can have a first arm, rigidly connected to the flap plate, and a second arm, rotatably mounted on one of the axes of rotation, the first arm and the second arm being coupled together by a second rotation joint. A linkage arrangement of such a kind results in a compact mode of construction, which makes it possible for the flap plate to be pressed down onto or lifted off from the sealing seat of the opening in substantially frictionless manner. In addition, a relatively high application pressure is achieved with, at the same time, a low drive moment, resulting in improved sealing of the arrangement In a preferred embodiment, the first and second rotation joints are, in the closed position, arranged on a common vertical axis. As a result, there is achieved, in a simple manner, an exclusively translational movement of the flap plate perpendicular to the plane of the opening and, associated therewith, plane-parallel lifting off and setting down of the flap plate.

The fixed-position axes of rotation can be arranged offset, relative to a vertical axis. In this case, the axis of rotation of the plate lever can be arranged closer than the axis of rotation of the actuation lever to a central axis of the opening. The offset arrangement of the axes of rotation results in different pivoting radii for the two levers so that an optimized movement path of the flap plate close to the housing of the opening, or of the material hopper, is brought about in a simple manner.

The first and second rotation joints can be movable on different pivoting paths, the rotation joints being spaced further apart from one another in the open position than in the closed position. This too ensures that, distal to the opening, the flap plate performs a movement that is guided close to the housing of the opening, whilst in the proximity of the opening or in the region of the opening a linear movement of the flap plate is accomplished.

Such an apparatus is also provided in the context of a blast furnace, as well as a method of closing or opening the opening, especially a bottom opening of a material hopper arranged above the mouth of a blast furnace.

BRIEF DESCRIPTION OF THE SEVERAL VIEWS OF THE DRAWING(S)

The invention will be explained in greater detail hereinbelow in terms of an example of an embodiment with further details, with reference being made to the accompanying drawings in diagrammatic form, in which.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
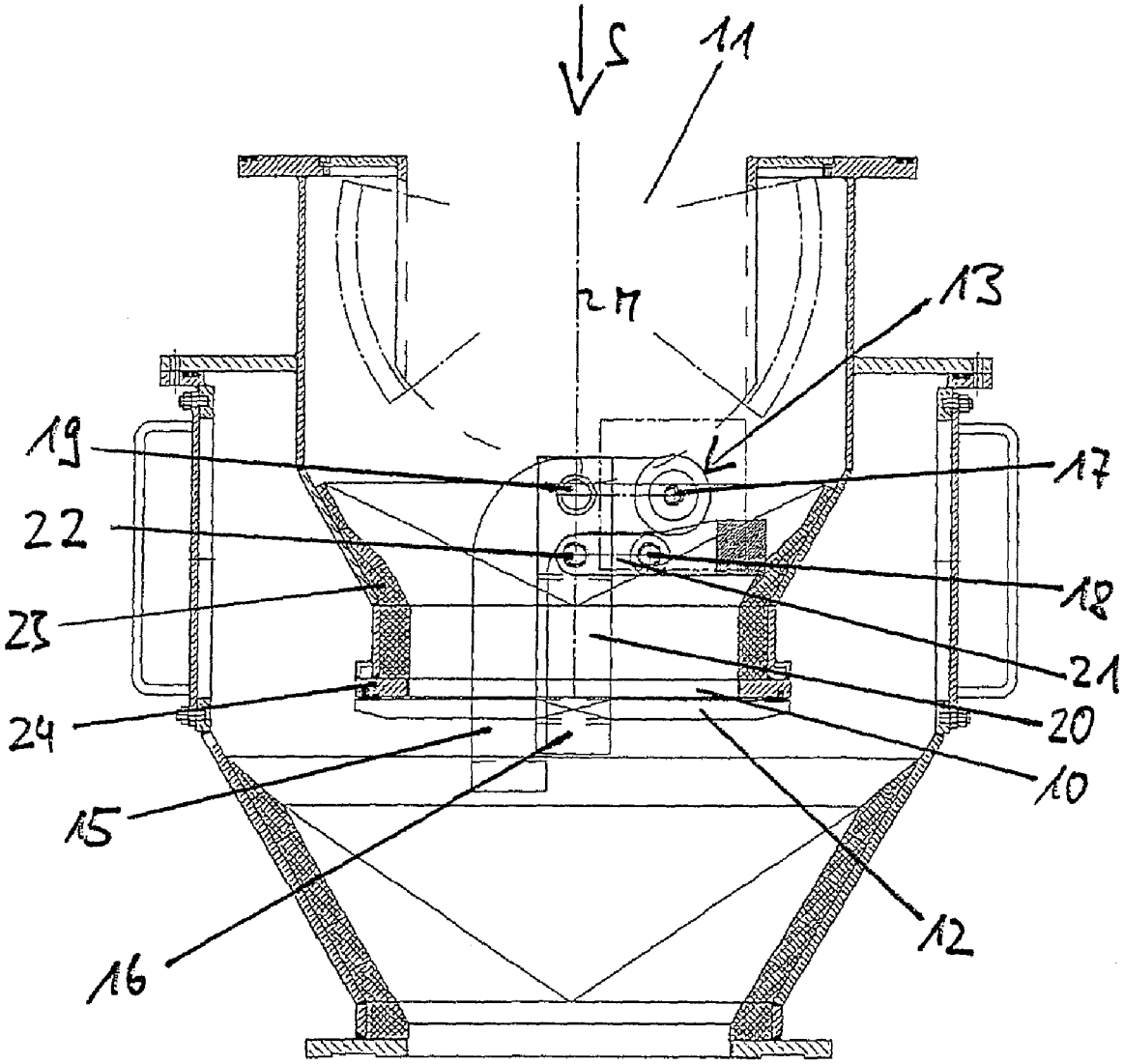
FIG. 1 is a cross-section through an apparatus according to an example of an embodiment according to the invention with a flap plate in the closed position.
Figure 2:
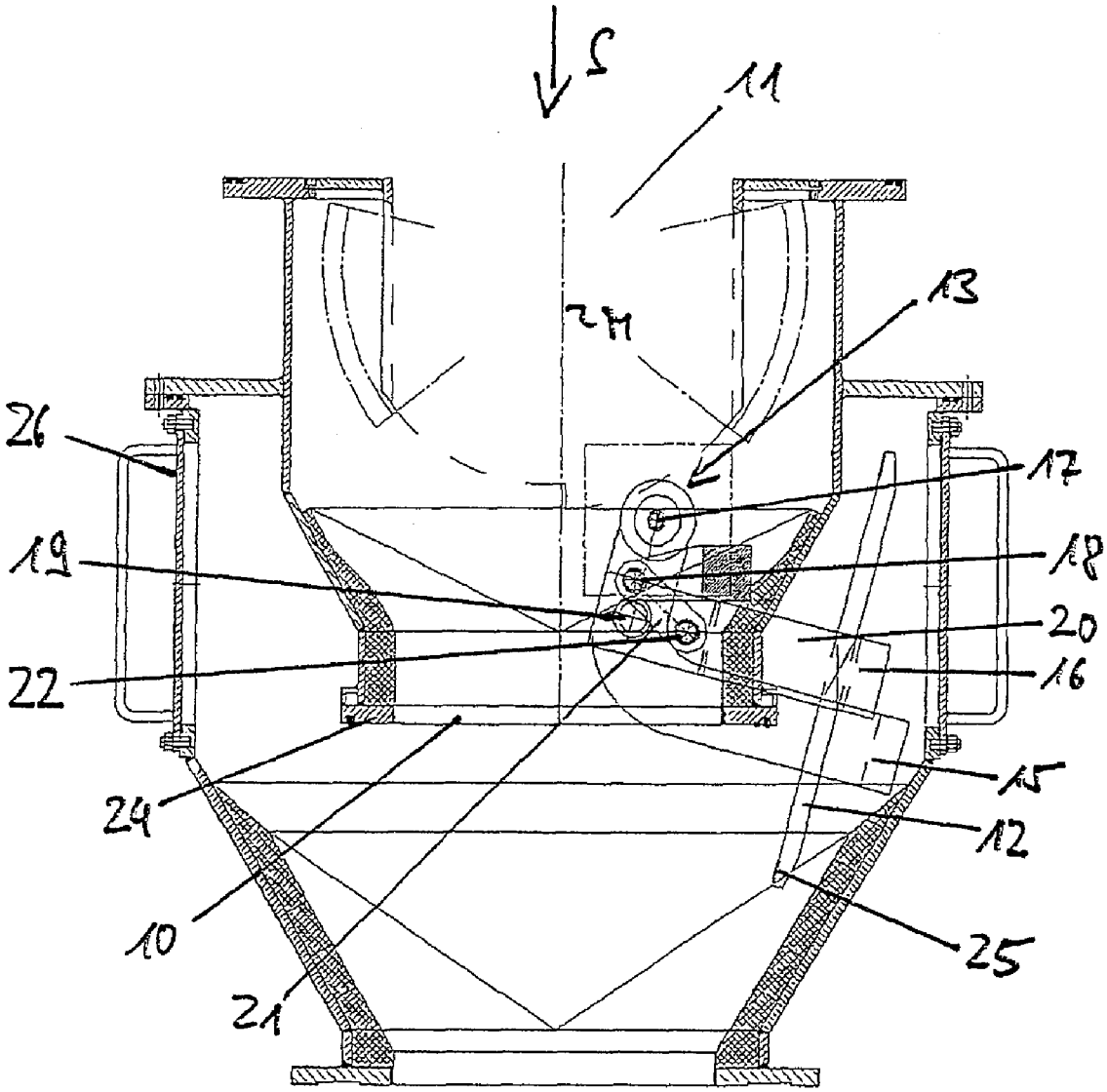
FIG. 2 shows the apparatus according to FIG. 1 with the flap plate in the open position.

FIGS. 1-4 show a furnace mouth flap valve having a flap plate 12, which is intended for closing or opening a bottom opening 10 of a material hopper 11 arranged above the mouth of a blast furnace. As a result of opening the flap plate 12, loose material, especially ores and burden material, is directed into the mouth of the blast furnace through the bottom opening 10 (FIG. 2). In the closed position, the bottom opening 10 is closed off in gas-tight manner by the flap plate 12 (FIG. 1).

The bottom opening 10 is arranged at the underneath of a funnel 23, which is connected to the material hopper 11. For the gas-tight closure of the bottom opening 10 there is provided at the rim of the opening a sealing seat 24 having sealing elements. As can be seen in FIG. 2, on the flap rim of the flap plate 12 there is provided a corresponding circumferential sealing surface 25, which in the closed position of the flap plate 12 co-operates with the sealing seat 24 to provide sealing.

The flap plate 12 is movable into a closed position (FIG. 1) and into an open position (FIG. 2), the flap plate 12 in the open position being arranged in a space between the funnel 23 and the housing 26 of the furnace mouth and, therefore, outside the fluid flow.

For the movement of the flap plate 12 into the open position and into the closed position and vice-versa the flap plate is connected to a linkage arrangement 13. The linkage arrangement 13 therein is so adapted that the flap plate 12 carries out, in the region of the bottom opening 10, a linear movement substantially perpendicular to the plane of the opening and, distal to the bottom opening 10, a pivoting movement. The pivoting movement can be seen especially in FIG. 3.

The linear movement of the flap plate 12 in the region of the bottom opening 10 indicates that the flap plate 12 is moved linearly, at least for as long as it is in contact with the bottom opening 10, specifically with the sealing seat 24. During this movement procedure, any relative movements in the plane of the opening, that is to say across the flow direction S, are critical because of the frictional wear which they cause. As a result of the linear movement of the flap plate 12 that is made possible in accordance with the invention, such frictional wear is avoided. As such, the setting down and pressing of the flap plate 12 on or against the sealing seat 24 and also the release of the application pressure and lifting off of the flap plate 12 from the sealing seat 24 are accomplished by an exclusively translational movement perpendicular to the plane of the opening. The flap plate 12 is therefore moved plane-parallel to the plane of the opening, that is to say to the plane passing through the bottom opening 10. Only then, that is to say when there is no contact between the flap plate 12 and the sealing seat 24 and any relative movements across the flow direction S are non-critical, is the flap plate 12 pivoted to the side and moved into the intermediate space between the funnel 23 and the furnace mouth housing 26.

The linkage arrangement 13 matched to this movement of the flap plate 12 is constructed in accordance with the example of an embodiment shown in FIGS. 1-4, as follows. Other linkage arrangements which make possible a linear movement of the flap plate 12 in the region of the bottom opening 10 connected to a pivoting movement distal to the bottom opening 10 are feasible.

In general terms, the linkage arrangement 13 includes a four-bar linkage, or four-member rotation joint linkage. This makes it possible for the linkage arrangement to be constructed in especially compact and robust manner.

Specifically, the linkage arrangement 13 includes two levers, especially an actuation lever 15, or in general terms a drive lever, and a plate lever 16, or in general terms a steering lever.

Figure 4:
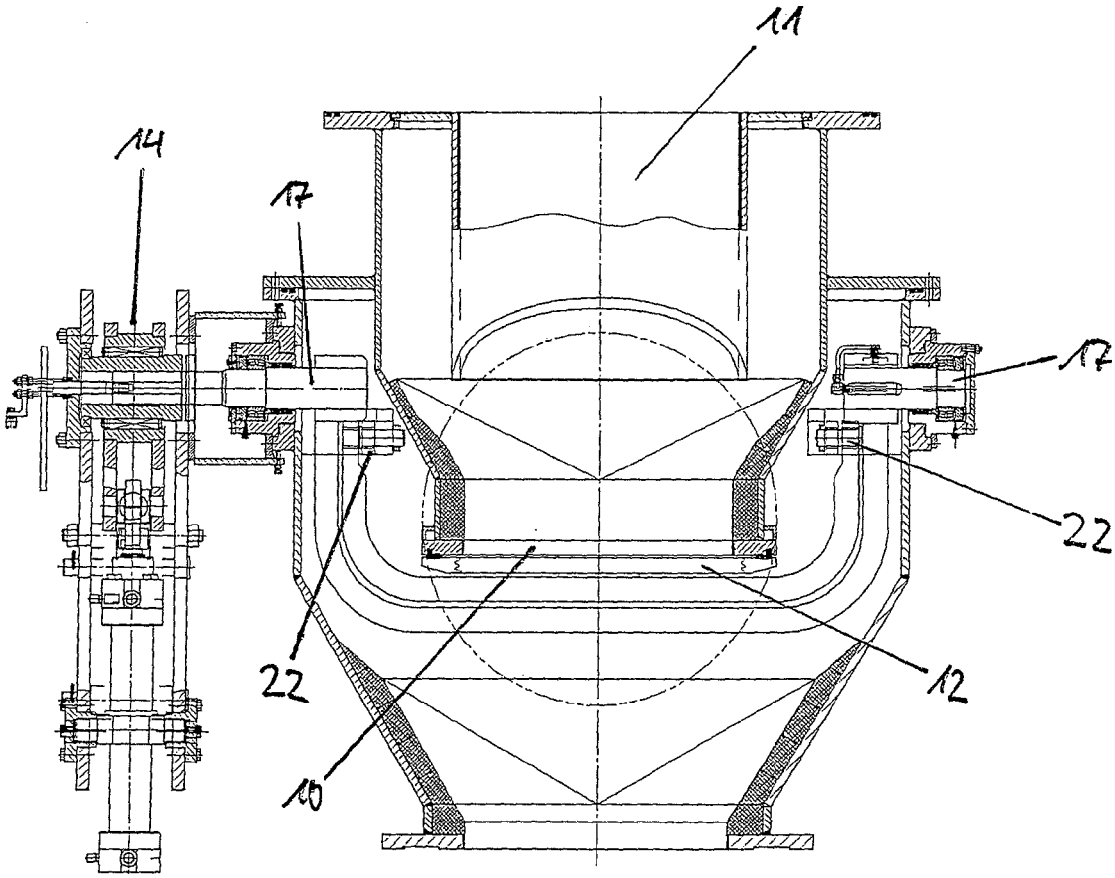
FIG. 4 shows the apparatus according to FIG. 1 in a section perpendicular to the section shown in FIG. 1.

The actuation lever 15 is of cranked construction and has two L-shaped portions, which are arranged on both sides of the funnel 23 and bottom opening 10 (FIG. 4). The two L-shaped portions of the actuation lever 15 are connected to one another so that the overall result is a combined U-L shape of the actuation lever 15, as can be seen in FIGS. 1 and 4. The actuation lever 15 passes underneath the flap plate 12 in the closed position, with the connecting part between the two L-pieces of the actuation lever 15 being arranged off-center with respect to the flap plate 12 (FIG. 1).

The plate lever 16 is of U-shaped construction and passes underneath the flap plate 12. The plate lever 16 is fixedly connected to the flap plate 12 and forms a rigid unit with the latter. In this arrangement, the plate lever 16 engages the flap plate 12 centrally, as a result of which centered introduction of the application force into the flap plate 12 and accordingly a uniform application pressure is achieved.

Figure 3:
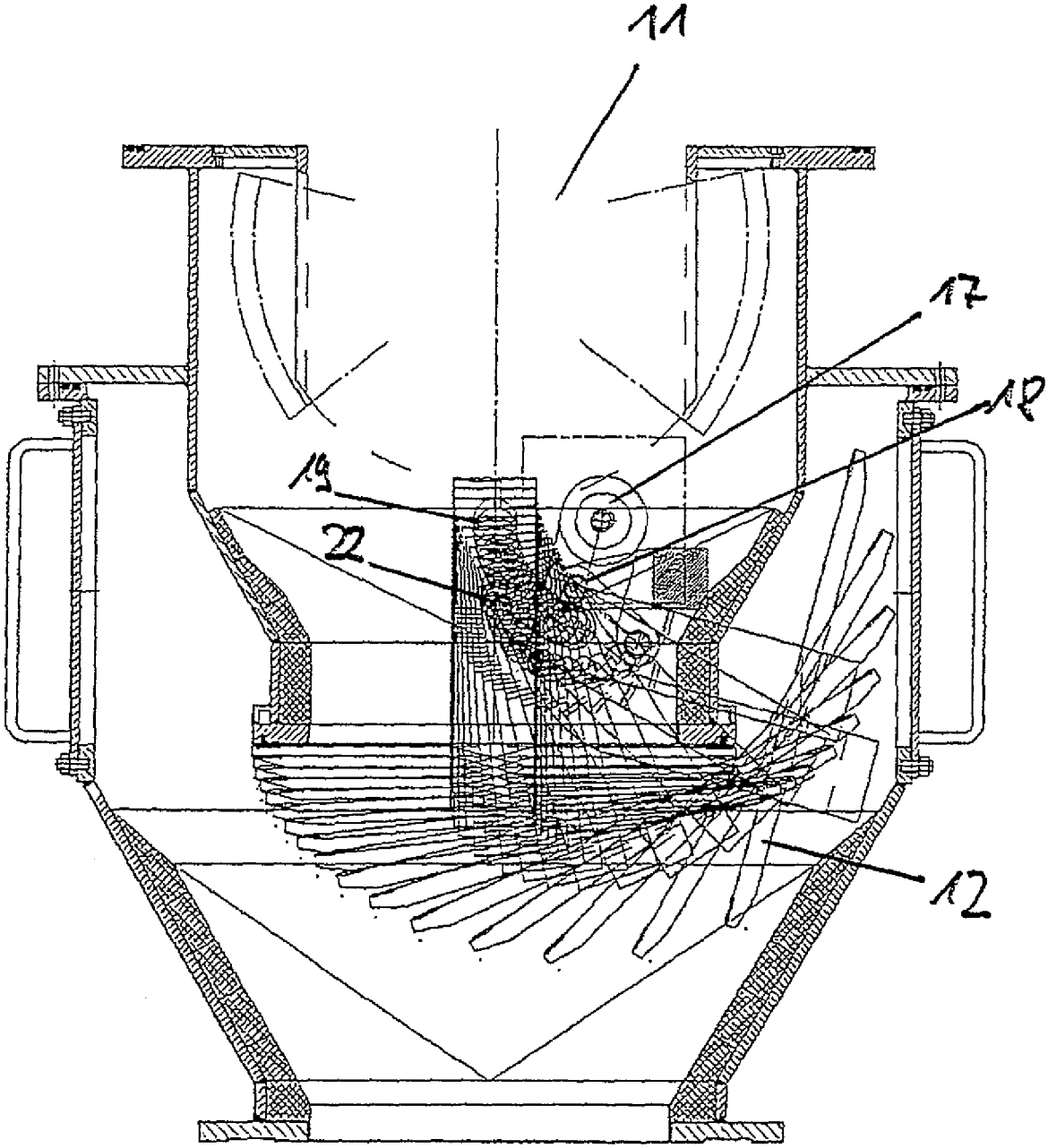
FIG. 3 shows an apparatus according to FIG. 1, with the movement sequence of the flap plate and of the associated lever mechanism being shown in discrete steps.

As can be seen in FIGS. 1-3, the actuation lever 15 and the plate lever 16 are in each case rotatably mounted on axes of rotation 17, 18 arranged in a fixed position. The axes of rotation 17, 18 are disposed spaced apart from one another, the axis of rotation 18 of the plate lever 16 being provided below the axis of rotation 17 of the actuation lever 15.

The two axes of rotation 17, 18 are furthermore arranged offset from one another, more specifically in relation to a vertical axis, the axis of rotation 18 of the plate lever 16 being arranged closer than the axis of rotation 17 of the actuation lever 15 to the center-line M of the bottom opening 10.

The actuation lever 15 has a first rotation joint 19, which in the closed position is arranged at the same height as the axis of rotation 17 of the actuation lever 15. In this arrangement the rotation joint 19 and the axis of rotation 17 are in each case arranged in the region of the shorter leg of the L-shaped portion of the actuation lever 15. In the closed position, the rotation joint 19 is arranged on the center-line M of the funnel 23 and bottom opening 10.

The rotation joint 19 forms an articulated connection between the actuation lever 15 and the plate lever 16. For this arrangement, or articulated connection, of the two levers the short leg of the L-shaped cranked actuation lever 15 would in itself be sufficient. However, for introduction of the pivoting moment from both sides into the linkage arrangement 13, connection of the two L-shaped parts of the actuation lever 15 on both sides of the bottom opening 10 and therefore the combined U-L shape of the actuation lever 15 is advantageous. As a result it is possible, as shown in FIG. 4, for the drive 14 to be provided on only one side of the linkage arrangement 13. In general it would be feasible, instead of introducing the moment into the linkage arrangement 13 from one side, for two positioning motors to be provided on the two sides of the bottom opening 10, both of which motors are coupled to the axes of rotation 17 of the actuation levers. In this case the motors would have to be synchronously controlled. Connecting the lateral actuation levers 15 would not be necessary in this case.

The plate lever 16 has a first arm 20 and a second arm 21, the first arm 20 being rigidly connected to the flap plate 12. The first arm 20 is of U-shaped construction, as shown in FIG. 4, and on both sides of the bottom opening 10 is coupled in articulated manner to the second arm 21 by a second rotation joint 22. By virtue of the axis of rotation 18 arranged in a fixed position, the second arm is mounted in rotatable manner and connected to the housing.

In the closed position, the second rotation joint 22 of the plate lever 16, which joint connects the two arms 20, 21, is arranged on the center-line M and therefore on the same vertical line as the first rotation joint 19 of the actuation lever 15.

The linkage arrangement 13 shown in FIG. 1 results in the fact that the second arm 21, mounted on the fixed-position axis of rotation 18, of opposite plate lever 16 is shorter than the short leg (which in the closed position according to FIG. 1 is arranged parallel thereto) of the L-shaped portion of the actuation lever 15.

The two rotation joints 19, 22 are arranged to be variable in terms of their position relative to the bottom opening 10.

The linkage arrangement 13 is of substantially analogous construction on both sides of the bottom opening 10.

The mode of operation of the furnace mouth flap valve is explained with reference to FIG. 3, which shows the spatial movement sequence of the flap plate 12 and of the associated lever mechanism in discrete steps, the end points of the movement being defined by the closed position of the flap plate 12 on the one hand (FIG. 1) and its open position on the other hand (FIG. 2).

By virtue of the arrangement of the two rotation joints 19, 21 on the center-line M in the closed position according to FIG. 1, on lifting off of the flap plate 12 there is first carried out a linear or exclusively translational movement of the flap plate 12 along the center-line M, or in the flow direction S. As a result of the spaced-apart arrangement of the two axes of rotation 17, 18 of the actuation lever 15 and plate lever 16, the originally linear movement of the flap plate 12 is converted into a pivoting movement which extends closely along the bottom opening 10 in order to avoid a collision with loose material. In the process, the actuation lever 15, or the longer leg of the L-shaped portion of the actuation lever 15, is initially arranged behind the plate lever 16 in the pivoting direction, that is to say the former runs behind the latter. Whilst the flap plate 12 is still located in the region of overlap with the bottom opening 10, the actuation lever 15 overtakes the plate lever 16 until the actuation lever 15 has performed about half the pivoting movement. Then the plate lever 16 overtakes the actuation lever 15 until the end position, that is to say the open position of the flap plate 12, has been reached. In the open position according to FIG. 2, the actuation lever 15 and the plate lever 16 re-assume the original arrangement relative to one another, wherein the actuation lever 15 is arranged behind the plate lever 16 in the pivoting direction (from the closed position to the open position).

For closing the bottom opening 10, the above-described sequence is carried out in the reverse order. In this context it should be mentioned that in the closed position according to FIG. 1, as a result of the arrangement of the two rotation joints 19, 22 on the centerline M, an application force acting perpendicular to the plane of the opening is transferred from the actuation lever 15 to the plate lever 16 and therefore to the flap plate 12 so that a relative movement between the flap plate 12 and the sealing seat 24 of the bottom opening 10 is largely avoided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for closing or opening an opening, especially a bottom opening of a material hopper arranged above the mouth of a blast furnace having a drivable flap plate, the flap plate being movable into an open position leaving the opening clear and into a closed position blocking off the opening and vice-versa, wherein the flap plate is connected to a four-bar linkage arrangement, the four-bar linkage arrangement including at least a first variable-position rotation joint and a second variable-position rotation joint, the first and second rotation joints each substantially aligned with a central vertical axis of the opening, such that the flap plate carries out, in the region of the opening, a linear movement substantially perpendicular to the plane of the opening and, distal to the opening, a pivoting movement.

2. An apparatus according to claim 1, wherein the pivoting movement of the flap plate includes, at least in the region of overlap of the flap plate with the opening, a translational movement parallel to the plane of the opening, on which there is superimposed a rotational movement.

3. An apparatus according to claim 1, wherein the four-bar linkage arrangement couples the flap plate to a drive.

4. An apparatus according to claim 1, wherein the four-bar linkage arrangement includes an actuation lever and a plate lever, which have axes of rotation arranged in fixed positions and spaced apart from one another.

5. An apparatus according to claim 4, wherein the actuation lever and the plate lever are coupled together by the first variable-position rotation joint.

6. An apparatus according to claim 4, wherein the plate lever has a first arm, rigidly connected to the flap plate, and a second arm rotatably mounted on one of the axes of rotation, the first and second arms being coupled together by the second variable-position rotation joint.

7. An apparatus according to claim 4, wherein the fixed-position axes of rotation are arranged offset, relative to a vertical axis.

8. An apparatus according to claim 7, wherein the axis of rotation of the plate lever is arranged closer than the axis of rotation of the actuation lever to a central axis of the opening.

9. An apparatus according to claim 6, wherein the first and second rotation joints are movable on different pivoting paths, the rotation joints being spaced further apart from one another in the open position of the flap plate than in the closed position of the flap plate.

10. A blast furnace having an apparatus according to claim 1.

11. An apparatus according to claim 1, wherein:

the material hopper defines a width profile when viewed in cross section;

the four-bar linkage arrangement further includes at least two axes of rotation arranged in fixed positions; and the at least two fixed-position axes of rotation are arranged within the width profile defined by the material hopper.

12. An apparatus according to claim 11, wherein the fixed-position axes of rotation are arranged offset, relative to a vertical axis.

13. An apparatus according to claim 11, wherein the first and second rotation joints are arranged within the width profile defined by the material hopper.

* * * * *